US005086623A

United States Patent [19]

Gauthier

[11] Patent Number: 5,086,623

[45] Date of Patent: Feb. 11, 1992

[54] REFRIGERATING PROCESS AND APPARATUS UTILIZING A REFRIGERATING MIXTURE

[75] Inventor: Pierre Gauthier, Fresnes, France

[73] Assignee: L'Air Liquide, Societe Anonyme pour l'Etude et l'Exploitation des Procedes Georges Claude, Paris, France

[21] Appl. No.: 591,076

[22] Filed: Oct. 1, 1990

[30] Foreign Application Priority Data

Oct. 9, 1989 [FR] France ..... 89 13158

[51] Int. Cl.[5] ..... E25B 1/00

[52] U.S. Cl. ..... 62/114; 62/502; 55/16

[58] Field of Search ..... 62/502, 43, 56, 115, 62/114; 55/16, 158

[56] References Cited

U.S. PATENT DOCUMENTS 1,866,526 7/1932 Davenport ..... 62/502

4,840,042 6/1989 Ikoma et al. ..... 62/502

*Primary Examiner*—Albert J. Makay

*Assistant Examiner*—John Sollecito

*Attorney, Agent, or Firm*—Curtis, Morris & Safford

[57] ABSTRACT

A light component of the compressed mixture is separated by permeation. The remaining heavy fraction is condensed with water, sub-cooled and expanded. The light component, cooled at the same temperature, is added to the sub-cooled condensate, and the whole is vaporized under low pressure to produce the required refrigeration.

14 Claims, 1 Drawing Sheet

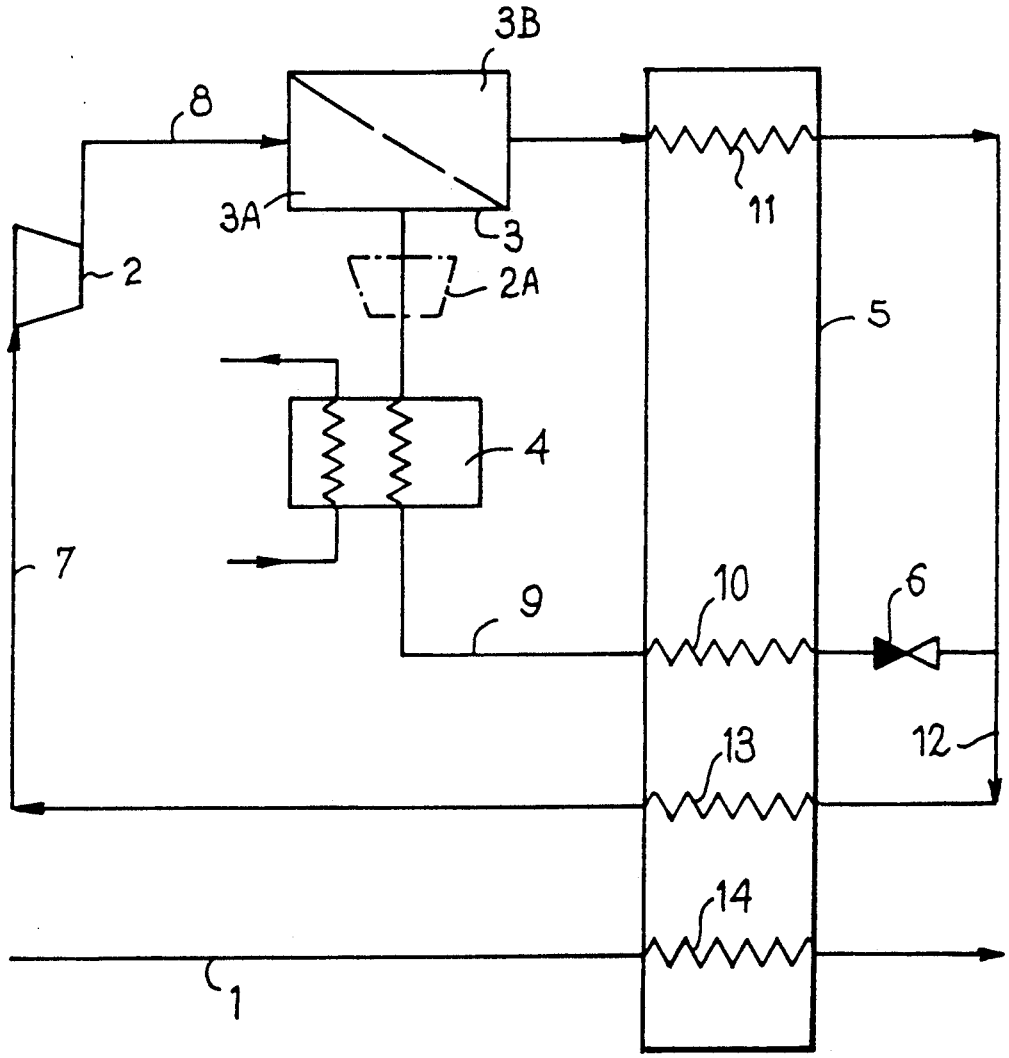
3B
8
3A
3
11
2
2A
5
4
7
9
10
6
12
13
14
1

REFRIGERATING PROCESS AND APPARATUS UTILIZING A REFRIGERATING MIXTURE

BACKGROUND OF INVENTION (a) Field of the Invention

The present invention relates to a refrigerating process and apparatus utilizing a refrigerating mixture. It concerns first a refrigerating process of the type in which a gas mixture undergoes a cycle comprising steps of compression at a high pressure of the cycle, of condensation by cooling at the high pressure, of expansion at a low pressure of the cycle and of vaporization at the low pressure.

(b) Description of Prior Art

The known cycles of refrigeration which utilize a pure substance as refrigerating fluid produce changes in this fluid between two temperatures, low T1 and high T2, and between two pressures, low P1 and high P2. In order that the cycle be economical and reliable, P1 is not chosen below atmospheric pressure; on the other hand, P2 is limited in its upper value by a maximum pressure which is lower than the critical pressure PC of the pure substance. Indeed, beyond this maximum pressure, the irreversibility of the thermodynamic cycle increases considerably. On the other hand, the high temperature T2 is usually room temperature to enable the use of a water or air condenser.

To reach lower cold temperatures, the technique of the so-called known cascade type has been proposed, which utilizes a succession of refrigerating cycles each using a pure substance. This solution is efficient but costly and not very reliable, since it utilizes a large number of compression machines.

To be able to rely on a single compressor, it has been proposed to use the processes of the type indicated above, according to the technique of the so-called "incorporated cascade". This solution has been found to be complicated to use and is only justifiable for large apparatuses.

SUMMARY OF INVENTION

The invention aims at providing a technique which is applicable to apparatuses of relatively small size and which, with a single cycle compressor, enables to lower the cold temperature in a simple manner.

For this purpose, it is an object of the invention to provide a process of the type mentioned above, characterized in that:

there is used a mixture comprising a heavy fraction and at least a light component;

the essential portion of said light component is separated from the heavy fraction by permeation between a step of compression and the step of condensation by cooling;

the step of condensation by cooling and the step of expansion only take place with the residue from the permeation;

the permeate is added to said expanded residue; and the step of vaporization is carried out with the whole of the mixture.

It is also an object of the invention to provide an apparatus intended to carry out such a process. This apparatus, of the type comprising a loop which includes in series a compressor, a condenser, expansion means and vaporization ducts of an indirect heat exchanger which is also provided with ducts for a fluid to be refrigerated, a mixture which is in gaseous state at the suction side of the compressor circulating through this loop, is characterized in that:

the gaseous mixture comprises a heavy fraction and at least a light component; and the loop contains, between the compressor and the condenser, a permeator which is clearly more permeable to said light component then to said heavy fraction, whose high pressure side is connected to the condenser and whose low pressure side is connected to the outlet of the expansion means.

BRIEF DESCRIPTION OF DRAWINGS

An embodiment of the invention will now be described with reference to the annexed drawing in which the single figure is a schematic representation of a refrigerating apparatus according to the invention.

DESCRIPTION OF PREFERRED EMBODIMENTS

The apparatus represented in the drawing is intended to cool a fluid which circulates in a duct 1. It comprises a single cycle compressor 2, a permeator 3, a condenser 4, an indirect heat exchanger 5 and an expansion valve 6.

The refrigerating cycle utilizes a refrigerating mixture consisting of a heavy fraction and at least a light component which can easily be separated from the latter by permeation, typically a mixture of propane and hydrogen and/or helium. This mixture arrives in gaseous state, via duct 7, at compressor 2 under a low pressure P1 about equal to atmospheric pressure and is compressed at pressure P2. The compressed mixture passes, via duct 8, in the high pressure area 3A of the permeator 3, which separates the essential portion of the hydrogen by selective permeation. Hydrogen thus passes into the low pressure area 3B of the permeator.

The residue from the permeation, essentially consisting of propane, is withdrawn from area 3A via duct 9. The latter passes through the water condenser 4, from which propane exits in liquid state at pressure P2 and at high temperature T2 close to room temperature.

The liquid propane then goes through first cooling ducts 10 of the exchanger 5, is sub-cooled therein at low temperature T1 of the cycle, then is expanded in valve 6 to a low pressure P1, which is advantageously close to atmospheric pressure.

The permeate, i.e. hydrogen, is also cooled at temperature T1 in second cooling ducts 11 of the exchanger 5, after which it is combined with expanded propane in a duct 12.

The mixture so reconstituted in diphasic form passes into heating vaporization ducts 13 of the exchanger 5, counter-currently of the circulation in ducts 10 and 11 and in ducts 14 of the same exchanger through which the fluid to be cooled circulates. In ducts 13, propane vaporizes in the presence of hydrogen.

It will be seen that, given pressure P1 and temperature T2 respectively equal to atmospheric pressure and room temperature for economical reasons;

the pressure P2, which is that required to give a condensation by water circulation, is the same as if the refrigerating fluid would be pure propane, since hydrogen is separated therefrom upstream of the condenser 4. This pressure P2 is therefore clearly lower than that which would be required in the absence of the permeator; and the temperature T1 is the temperature at the start of the vaporization of propane in the presence of hydrogen under atmospheric pressure. This temperature is clearly lower than that which enables to give propane alone.

In other words, the light component is separated from the mixture when it has an unfavorable effect (before the step of condensation), and is re-introduced into the mixture when it has a favorable effect (before the step of vaporization).

The permeator 3 is adapted to separate hydrogen from the other components of the mixture which is introduced therein, for example by means of a network of hollow fibers consisting of a membrane with selective permeability. An example of such membrane which is suitable for this application is based on an aromatic polyamide technology developed by DU PONT DE NEMOURS according to patent Re 30,351 (Reissue of U.S. Pat. No. 3,899,309). Other examples are described in U.S. Pat. Nos. 4,180,553 and U.S. Pat. No. 4,230,463. The permeation parameters are adjusted so that the low pressure area 3B is substantially at low pressure P1, in the vicinity of atmospheric pressure, in the example under consideration.

By way of numerical example, a known propane cycle, with P1=1 bar absolute, P2=11 bars absolute, and T2=+30° C., enables to give a cold temperature at 42° −C., which is the vaporization temperature of propane under 1 bar. With the permeator 3 and a mixture 50 % propane, 50 % hydrogen, vaporization ends at about −57° C.

As a variant, as indicated in mixed line in the drawing, if the permeation can be carried out at a pressure lower than P2, it may be advantageous to compress the mixture only up to this pressure p before it undergoes permeation, only the residue being thereafter compressed by means of a second compressor 2A at pressure P2, upstream of the exchanger 4. The compressor 2A may in particular constitute the last stage of the unique cycle compressor.

We claim:

1. Apparatus for refrigeration with a refrigerating mixture, of the type comprising a loop which includes in series a having a suction side compressor (2), a condenser (4), means of expansion having an outlet (6) and vaporization ducts (13) of an indirect heat exchanger (5) which additionally contains ducts (14) for a fluid to be refrigerated, a mixture which is gaseous at the suction side of the compressor running through said loop, wherein:

the gaseous mixture comprises a heavy fraction and at least a light component; and the loop comprises, between the compressor (2) and the condenser (4), a permeator having a high pressure side and a low pressure side (3) which is clearly more permeable to said light component than to said heavy fraction, whose high pressure side (3A) is connected to the condenser (4) and whose low pressure side (3B) is connected to the outlet of the expansion means (6).

2. Apparatus according to claim 1, wherein the high pressure side (3A) of the permeator (3) is directly connected to the condenser (4).

3. Apparatus according to claim 1, wherein the high pressure side (3A) of the permeator (3) is connected to the condenser (4) by means of a second compressor (2A).

4. Apparatus according to claim 1, wherein the heat exchanger (5) comprises sub-cooling ducts (10) connected between the condenser (4) and the expansion means (6).

5. Apparatus according to claim 1, wherein the heat exchanger (5) comprises cooling ducts (11) connected between the low pressure side (3B) of the permeator (3) and the outlet of the expansion means (6).

6. Apparatus according to claim 1, wherein said light component is hydrogen and/or helium.

7. A refrigeration process utilizing a gas mixture of at least one relatively light component and a relatively heavy fraction, comprising the cycle of compressing the gas mixture to a relatively high pressure; separating at least a portion of the at least one relatively light component from the compressed gas mixture by permeation to provide a residue and a permeate; condensing by cooling only said residue; expanding only said residue; adding said permeate to the expanded residue to form a mixture; and vaporizing said mixture to provide said gas mixture.

8. The process of claim 7 wherein the cycle includes a single compressing step.

9. The process of claim 7 further comprising the step of compressing the residue prior to condensing by cooling.

10. The process of claim 7 further comprising the step of sub-cooling the condensed residue prior to expanding it.

11. The process of claim 7 further comprising the step of cooling said permeate prior to adding it to said expanded residue.

12. The process of claim 7 wherein said at least one relatively light component is hydrogen.

13. The process of claim 7 wherein said at least one relatively light component is helium.

14. The process of claim 7 wherein said at least one relatively light component is a mixture of hydrogen and helium.

* * * * *

UNITED STATES PATENT AND TRADEMARK OFFICE

CERTIFICATE OF CORRECTION

PATENT NO. : 5,086,623

DATED : February 11, 1992

INVENTOR(S) : Pierre Gauthier

It is certified that error appears in the above-identified patent and that said Letters Patent is hereby corrected as shown below:

Claim 1, line 3, Column 3, line 44, after "a" (first occurrence) delete "having a suction side"; after "compressor" insert --having a suction side--.

Signed and Sealed this

Twenty-seventh Day of April, 1993

*Attest:*

*Attesting Officer*

MICHAEL K. KIRK

*Acting Commissioner of Patents and Trademarks*